US008959668B1

(12) United States Patent
Ganes et al.

(10) Patent No.: US 8,959,668 B1
(45) Date of Patent: Feb. 24, 2015

(54) CHINSTRAP WITH JAW PROTECTION

(71) Applicants: Matthew S. Ganes, New York, NY (US); Paul M. Jepsen, Brooklyn, NY (US)

(72) Inventors: Matthew S. Ganes, New York, NY (US); Paul M. Jepsen, Brooklyn, NY (US)

( * ) Notice: Subject to any disclaimer, the term of this patent is extended or adjusted under 35 U.S.C. 154(b) by 0 days.

(21) Appl. No.: 14/189,392

(22) Filed: Feb. 25, 2014

(51) Int. Cl.
*A42B 7/00* (2006.01)
*A42B 3/20* (2006.01)
*A42B 3/08* (2006.01)

(52) U.S. Cl.
CPC .. *A42B 3/205* (2013.01); *A42B 3/08* (2013.01)
USPC ..... 2/421; 2/410; 2/425; 2/9

(58) Field of Classification Search
CPC ..... A42B 3/08; A42B 3/085
USPC ..... 2/9, 410–411, 421–422, 425, 455; 606/204.15
See application file for complete search history.

(56) References Cited

U.S. PATENT DOCUMENTS

| | | | | |
|---|---|---|---|---|
| 649,896 | A | 5/1900 | Baughman | |
| 2,847,003 | A * | 8/1958 | Helmer et al. | 128/861 |
| 4,651,356 | A | 3/1987 | Zide | |
| 4,741,054 | A | 5/1988 | Mattes | |
| 5,737,777 | A | 4/1998 | Hilleary | |
| 5,794,274 | A * | 8/1998 | Kraemer | 2/421 |
| 6,081,932 | A | 7/2000 | Kraemer | |
| 7,886,370 | B2 | 2/2011 | Winningham | |
| 2007/0124842 | A1 * | 6/2007 | Nascimento et al. | 2/9 |
| 2010/0319109 | A1 | 12/2010 | Field | |

* cited by examiner

*Primary Examiner* — Khoa Huynh
*Assistant Examiner* — Khaled Annis
(74) *Attorney, Agent, or Firm* — H. Jay Spiegel

(57) ABSTRACT

A device includes a chinstrap with two or four-point attachment which also incorporates jaw protection and inertia displacement. The chin protection consists of a padded chin cup with interior webbing to align the chin cup on the user's chin. To either side of the chin cup, jaw protecting portions laterally emanate to either side of the chin along the jaw line of the user/wearer. These jaw protecting structures are as wide as the chin cup at their attachments to the chin cup and may taper to a thinner configuration as they extend away from the chin cup. In the preferred embodiment of the present invention, two opposed straps emanate laterally to either side of the chin cup and two other straps emanate laterally from respective ones of the jaw protecting structures. An alternate embodiment with only two attachment points is also disclosed.

16 Claims, 6 Drawing Sheets

CHINSTRAP WITH JAW PROTECTION

BACKGROUND OF THE INVENTION

The present invention relates to a chinstrap with jaw protection. In many sports in which contact with the player's head is likely, it is often the case that it is a requirement or option to wear a protective helmet. In most cases, when a protective helmet is worn, it also has a chin strap that extends from either side of the head around the chin in order to secure the helmet in place. In some sports such as football, lacrosse or hockey, in order to properly and consistently secure the chinstrap in place engaging the chin of the wearer, chinstraps with two or four-point attachment are employed. In essence, such chinstraps have one or two straps emanating from each side of a cup-like structure designed to envelop the chin of the wearer. In the case of four-point attachment, each of these straps extends in a slightly different direction from the others and there are four points of attachment on the helmet. In the case of the two-point strap, each of these straps extends in a similar direction and there are two points of attachment on the helmet. In most such applications, the attachments are by way of snap fasteners, although other attachment means may certainly be employed such as a cam buckle fastening system.

While the art of chinstraps is well-developed, it is also the case that protection of the jaw to either side of the cup-like member has not yet occurred to any significant degree. While some have claimed that the straps themselves afford some jaw protection, this is not actually the case because straps have not been designed specifically for that purpose.

As such, a need has developed for a fastening device for a helmet that incorporates both chin protection and jaw protection for the wearer. This is particularly important in activities where impacts to the face, chin or head can occur, for example, for lacrosse and football players. This is because, in football, it is possible for the hand (or fist), elbow, or helmet of another player to enter the area of the wearer's head between the lower edge of the face guard and the neck and cause damage whether inadvertently or intentionally. Similarly, in lacrosse helmets, while a jaw protecting structure is often provided at the bottom of the face mask, it is still possible for the jaw of the wearer to be impacted by any part of a lacrosse stick or by a lacrosse ball, causing severe injury. The present invention can be used with any protective headgear including but not limited to military, motorcycle, bicycle, construction and other sports. As such, it is with the need to resolve this important safety issue that the present invention was developed.

The following prior art is known to Applicants:

U.S. Pat. No. 649,896 to Baughman discloses a head bandage which includes a chin engaging member fastened to the head of the wearer by opposed straps. Baughman fails to teach the concept of protecting the jaw of the wearer and is solely concerned with bandaging and holding the jaw in a desired orientation.

U.S. Pat. No. 4,651,356 to Zide discloses a helmet chinstrap of the four-point attachment variety. Zide teaches a chin cup that is "quite stiff or rigid particularly at its center to provide maximum protection to the chin, and diminishes gradually in thickness and in rigidity toward its marginal edges which are of reduced thickness." It is beyond those thinner areas where the jaw protection of the present invention is contemplated, and the thinning of the peripheral sides of the chin cup of Zide indicates a lack of attention to jaw protection.

U.S. Pat. No. 4,741,054 to Mattes discloses a chin cup for use with military headgear which also includes a four-point attachment system with double straps to either side of a chin cup. The chin cup does not extend beyond the area of the chin and the straps are not shown to be padded in any respect. In fact, they are disclosed as made of NYLON. Mattes also discloses a chin cup made of high density foam.

U.S. Pat. No. 5,737,777 to Hilleary discloses a helmet strap assembly having contoured support member which includes a strap 12 designed to extend at the throat area of the user. The strap of Hilleary is disclosed as crossing under the person's jaw and having a sleeve member designed to minimize chafing against the wearer's skin. However, as the Hilleary strap is intended to be used, well beneath and rearward of the chin of the user, it does not provide any protection for the jaw line of the wearer extending between the chin and toward the sides of a helmet worn by the user.

U.S. Pat. No. 5,794,274 to Kraemer discloses a chin protector on a 4-point chinstrap system, including inner and outer protectors separated by a suspension means. Kraemer does not contemplate use of webbing as does the present invention.

U.S. Pat. No. 6,081,932 to Kraemer discloses a chinstrap assembly for use with an athletic helmet that includes a four-point attachment system and a chin guard that extends for a short distance laterally to either side of the chin. These extended areas are intended to provide connecting portions to allow connection and adjustment of the straps. As the chin cup is disclosed as "relatively rigid," and any padding intended for the chin cup is disclosed as comprising a foam insert, it is clear that the side extensions of the chin cup disclosed by Kraemer would not perform any protective function for the jaw of the wearer.

U.S. Published Application No. US 2010/0319109 to Field discloses a chin protector with an unillustrated "generally elastic compressible internal pad." This document does not disclose the webbing of the present invention.

U.S. Pat. No. 7,886,370 to Winningham discloses a protective chin pad and inertia displacement assembly for sporting helmets and method of construction thereof. The Winningham device has four-point attachment, but utilizes snap fasteners and rings to affix the straps to the chin cup. The chin cup is not disclosed as providing protection to any other facial structure other than the chin.

SUMMARY OF THE INVENTION

The present invention relates to a chinstrap with jaw protection. The present invention overcomes the deficiencies of the prior art and provides a new, useful and unobvious chinstrap with jaw protection having the following objects, aspects and features:

(1) In a first aspect, the present invention contemplates a device including a chinstrap with two or four-point attachment which also incorporates jaw protection and inertia displacement. In so doing, the chin protection preferably consists of a padded chin cup that may also include interior webbing designed to best facilitate alignment of the chin cup on the user's chin and additional cushioning effect. In the specification and claims, the expressions "chin cup" and "chin pad" are intended to refer to the same structure as disclosed herein. The webbing displaces energy imposed upon it including mechanical impulses arriving from any direction or angle, and absorbs impacts as a result. The chin cup preferably consists of a high density (outer) and low density (inner) foam combination piece that hovers underneath and up around the entire chin area. Outer high density foam (HDF) is adhered or molded to a softer lower density foam (LDF) that runs along the inside of the open cup on each of the embodiments. The LDF is preferably ribbed-shaped with vertical strips on the outermost area of the LDF near the face. These ribs run along the entire length of the chin cup, top to bottom, providing air flow channels and impact protection. This facilitates impact control with the webbing. Around the chin bone, there is preferably an elastic polymer based material with inertia displacement qualities. The foam and the polymer, or webbing, create approximately ¼ to ½ inch of open space between them allowing the webbing to stretch on impact and for air to flow in and out of the area. This is a non-closed off, floating system. Due to the open air chin design, the need is reduced for large open areas in the padding for ventilation and moisture release like in the prior art. However, two drainage columns may be aligned to channel and release moisture out of the lowest point of the device, ensuring that sweat is allowed to drain quickly and easily. The foam is attached to the webbing along the bottom edge of the chin webbing. The entire piece then contours to the shape of the wearer's face due to flexible molding qualities of the materials employed.

(2) To either side of the chin cup, jaw protecting portions laterally emanate to either side of the chin along the jaw line of the user/wearer. These jaw protecting structures are preferably as wide as the chin cup at their attachments to the chin cup and may taper to a thinner configuration as they extend away from the chin cup. However, wing-shaped pads do not necessarily taper away from the location of the chin. They will take whatever shape necessary to best protect the jaw based on the helmet they are used with. The connecting edge angle of the wing pad will preferably be diametrically opposed to that of the chin pad to ensure overlapping protection along the connection seam. Each wing pad will be attached to the outside of the chin pad. Whereas the chin pad attaches directly to the bottom edge of the webbing, the wing will preferably attach directly to the chin pad material, thereby ensuring comfort, flexibility, and protection.

(3) In the preferred embodiment of the present invention, concerning the four-point attachment system, as explained in greater detail below in the Specific Description of the Preferred Embodiments, two opposed strap assemblies emanate laterally to either side of the chin cup. Each assembly includes a common attachment area that attaches to a side surface of the webbing. Two straps emanate from the common attachment area and include distal ends carrying attachments such as snaps, rivets, adjustable cam buckles or the like facilitating attachment at spaced areas on a helmet. On each strap assembly, at least one of the straps attaches to a jaw protector on that side either extending through a centrally located slot on the jaw protector or at an end of the jaw protector remote from the chin cup. In an alternative embodiment, a two-point attachment system is employed in which a single strap is located to each side of the chin cup and attaches at a single attachment point on a helmet.

(4) If desired, the chin cup or its webbing may provide an attachment for the strap of a mouth guard which facilitates retaining the mouth guard and avoiding losing it. Alternatively, the strap can be molded or fabricated integrally with the chin cup or webbing or the chin cup or webbing can have a strap or leash to which the mouth guard strap can be attached, made of the same material as the webbing.

(5) The webbing which assists in alignment of the chin cup on the chin of the wearer also provides impact absorption due to its semi-elastic quality. The webbing can, if desired, be made of an elastic polymer or elastomer. The perforated webbing is water resistant and anti-microbial. It also may have a soft, non-abrasive, non-slip wicking material inside of the webbing, directly against the skin to deter skin infection.

(6) The jaw protecting structures which also will be described as "wing" pads may be made to extend as far toward the lower attachment points on the helmet as is desired. It is only necessary for them to terminate in straps for the purpose of attachment to the helmet. These wing pads are made sufficiently thick enough that their inner surfaces engage the jaw line of the wearer with the associated straps attached to the helmet. Due to this design, the attachment of the pad to the webbing is only along one axis. The bottom edge of the webbing will be reinforced with extra material and will not be perforated in order to provide the most substantial connection possible. In order to accommodate various helmet designs, the wing pads can have a cut-through design that allows each pad to fit securely against the jaw. The strap enters through the back of the wing, and exits through the front of the pad, and possibly the shield due to the straps emanating further away from the face in order to connect to the outside of the certain helmets.

(7) If desired, the chin cup may be made of a combination of high density foam (HDF) and low density foam (LDF), and the wing pads may be made of the same material. An Impact Density Memory Foam that is pre-shaped may contour with the chin and jaw line. The foam has properties that allow it to return to its original shape after impact. Alternatively, these pads could be made of polyurethane, foam rubber, foam plastic, or even may include carbon fiber plates to strengthen them and provide a higher degree of impact protection by way of incorporating deflection as a means of impact protection.

(8) The straps, if desired, may be made of NYLON or a synthetic non-elastic polymer, whether woven or molded or perhaps leather. Straps may be coated with a material designed to deter attachment of bacteria or other microbes and to repel liquids including water, saliva, etc. Both two-point straps may have carbon connector pieces that span between the side of the chin guard and the front half of the wing on each side, stabilizing the wing around the jaw line for optimal jaw protection.

(9) The present invention acts as a shock absorbing device that minimizes the maximum value of a mechanical impulse received by it, and limits transmission of such impulses to the wearer's brain, thereby reducing incidences of concussions. The disclosed elastic webbing and space the chin has to move due to the floating chin pad enhances this protective effect.

(10) The present invention is useful in activities besides football and lacrosse, including softball, baseball, wrestling, horse racing, horseback riding, skydiving, skiing, snowboarding, and any sport or activity that requires a helmet.

As such, it is a first object of the present invention to provide a chinstrap with jaw protection.

It is a further object of the present invention to provide such a device which employs two or four-point attachment for enhanced stability and safety.

It is a yet further object of the present invention to provide such a device in which the jaw protection consists of wing pads emanating laterally to either side of a chin cup and the wing pads may have height or width dimension equal to that of the chin cup where they emanate.

It is a yet further object of the present invention to provide such a device in which the wing pads may taper to a thinner configuration in a direction away from the chin cup.

It is a still further object of the present invention to provide such a device in which the chin cup may be made of a high and/or low density foam and the wing pads may be made of the same material(s).

It is a still further object of the present invention to provide such a device in which the wing pads may incorporate carbon fiber technology to enhance their strength.

It is a yet further object of the present invention to provide such a device in which the chin cup also incorporates a webbed cup-like structure to assist in aligning the chin cup in its correct installed location and to enhance strike protection and inertia displacement.

It is a still further object of the present invention to provide points of attachment on an associated helmet to facilitate attachment of the straps thereto, including snap fasteners or other fastening means.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
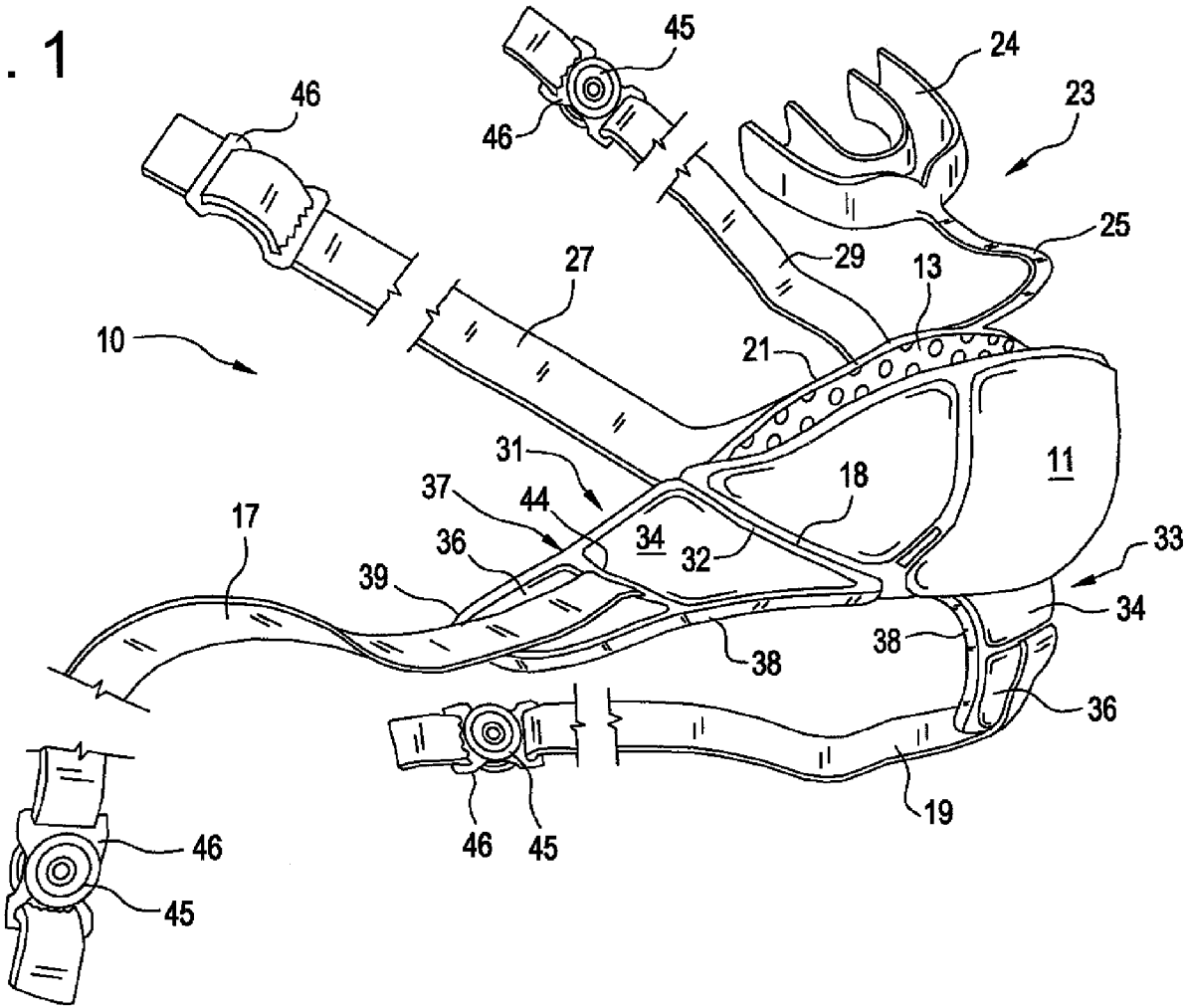
FIG. 1 shows a perspective view of a preferred embodiment of the present invention in which four-point attachment is employed and the chin cup is relatively large and completely overlies the webbing.

With reference, first, to FIG. 1, a first embodiment of the present invention is generally designated by the reference numeral 10 and is seen to include a chin cup 11 to which is mounted a webbing structure 13 to which may be affixed a mouth guard system 23 including a mouth guard 24 and attachment strap 25. The webbing structure is spaced from the inner surfaces of the chin cup by a distance of about ½" to enhance absorption of impacts and protect the chin and brain while providing ventilation and drainage. Concerning ventilation and drainage, reference is made to FIG. 5 which shows the chin cup 11 and the webbing 13 with a space 14 therebetween to permit air flow and ventilation and with a drainage vent 16 that allows drainage of saliva, sweat or other fluids from the area of the chin cup 11 and webbing 13.

The chin cup 11 includes side extremities of which one is shown in FIG. 1 and designated by the reference numeral 18. As shown in FIG. 1, wing-like jaw protectors 31 and 33 are attached to those extremities. Straps 17, 19 are attached to the jaw protectors. As straps 17 and 19 emanate away from the webbing 13, they come through the middle of wing-like jaw protector pads 31 and 33 in order to keep the pads closer to the face when straps 17 and 19 attach to the helmet. Additionally, the webbing 13 has an edge 21 to which are attached additional straps 27 and 29. Straps 17 and 19 attach to both the inside of the jaw protectors 31 and 33 and directly to 21, webbing edge 13. See FIG. 6.

The jaw protector 31 includes an interface edge 32 that abuts the extremity 18 of the chin cup 11. These edges are affixed together in any suitable manner. For example, stitching or adhesive may be employed. A similar interface is provided to attach the jaw protector 33 to the chin cup 11. In the embodiment of FIG. 1, the chin cup 11 is relatively large with respect to the webbing 13 to provide more chin protection, for example, for a football player.

Figure 2:
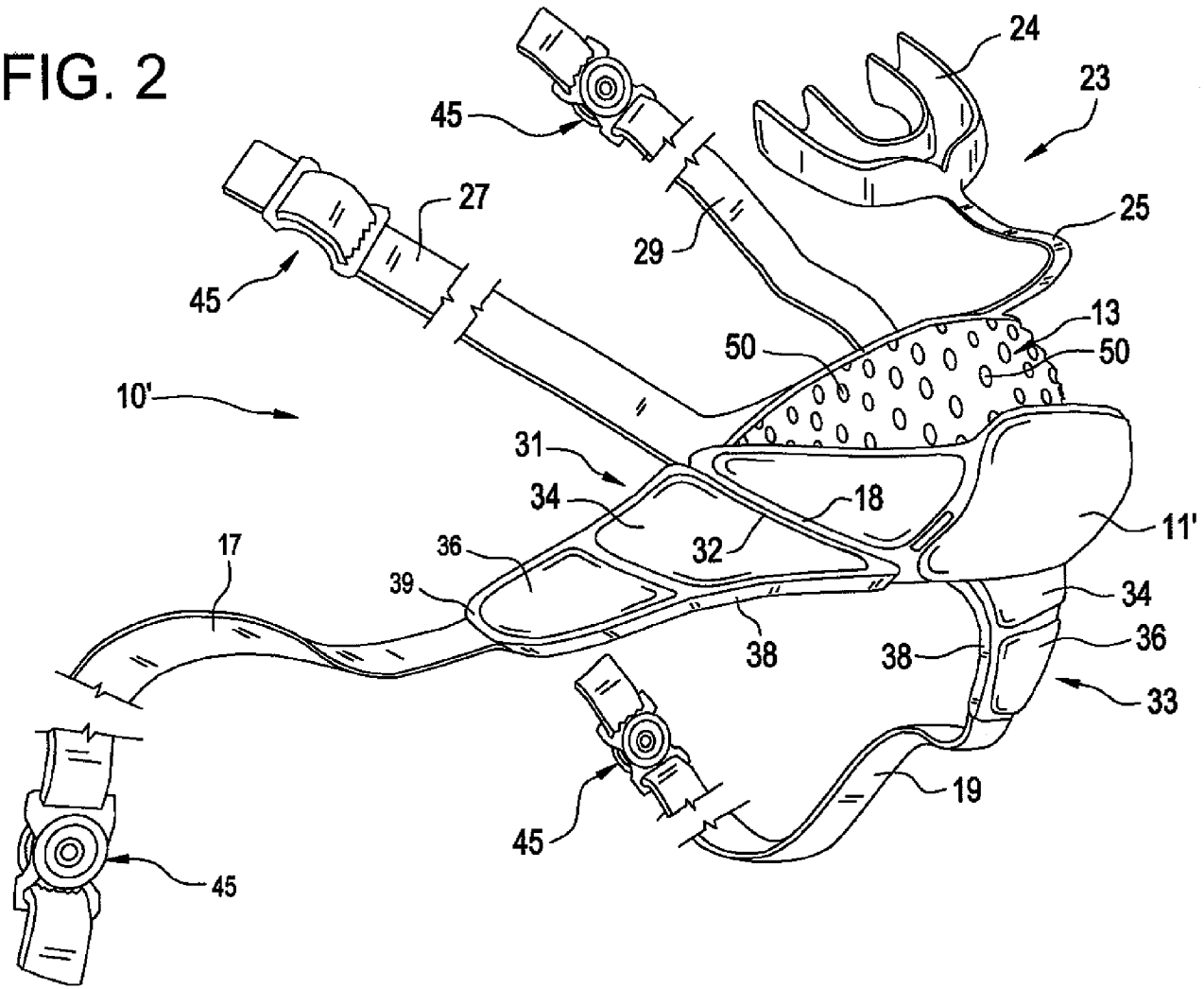
FIG. 2 shows an alternate four-point attachment embodiment in perspective in which the chin cup is lower profile.

In the embodiment of FIG. 1, the jaw protectors 31 and 33 are generally triangular in configuration. With particular reference to the jaw protector 31, the strap 17 extends through a slot 44 at a location 37 midway between the end 39 of the jaw protector 31 and its interface edge 32 with the extremity 18 of the chin cup 11. The strap then extends under the jaw protector 31 and attaches to webbing 13 (see FIG. 6). By contrast, in the embodiment of FIG. 2 showing the second embodiment 10', the strap 17 is affixed at the end 39 of the jaw protector 31, and then extends under the jaw protector 31 to a point of attachment to the webbing 13 (see FIG. 6). In each case, straps include snap fasteners such as designated by the reference numeral 45 intended to couple with the mating half mounted at a desired location on a helmet.

In the embodiments of FIGS. 1-2, the particular shape and configuration of the jaw protectors may be any desired shape that provides adequate protection for the jaw of the wearer. The configurations shown are two alternatives and others may be contemplated by those of ordinary skill in the art.

In all of the embodiments of the present invention, the jaw protecting pads have significant thickness to provide significant cushioning effect with respect to the jaw line of the wearer from the sides of the chin cup and in a significant distance toward where the straps 17 and 19 attach to the attachment points on the helmet (not shown). The snap fasteners 45 in the example shown (FIG. 1) includes a bracket 46 to which the snap fastener half 45 is attached and includes slots to receive the strap 17 in a manner allowing length adjustment of the distance between the chin cup 11 and the snap fastener 45. Of course, snap fasteners are known per se. See, for example, U.S. Pat. No. 4,651,356 to Zide (FIG. 1) and U.S. Pat. No. 7,886,370 to Winningham (FIG. 1). Of course, other fastening means may be employed including rivets and a cam buckle fastening system (not shown).

FIG. 2 shows more details of the webbing 13 which includes a plurality of holes 50 which allow ventilation and provide flexibility. If desired, the strap 25 may be integral with the webbing 13 or may be formed separately and affixed thereto. FIGS. 1-2 also show the jaw protectors having carbon fiber plates 34 and 36 attached over a padded structure 38. If desired, the padded structure 38 may have recesses within which the carbon fiber plates 34 and 36 are embedded and affixed by any suitable means such as an adhesive. These carbon fiber plates 34 and 36 enhance the impact protection of the jaw protector. If desired, hard plastic can be substituted for carbon fiber material.

Figure 6:
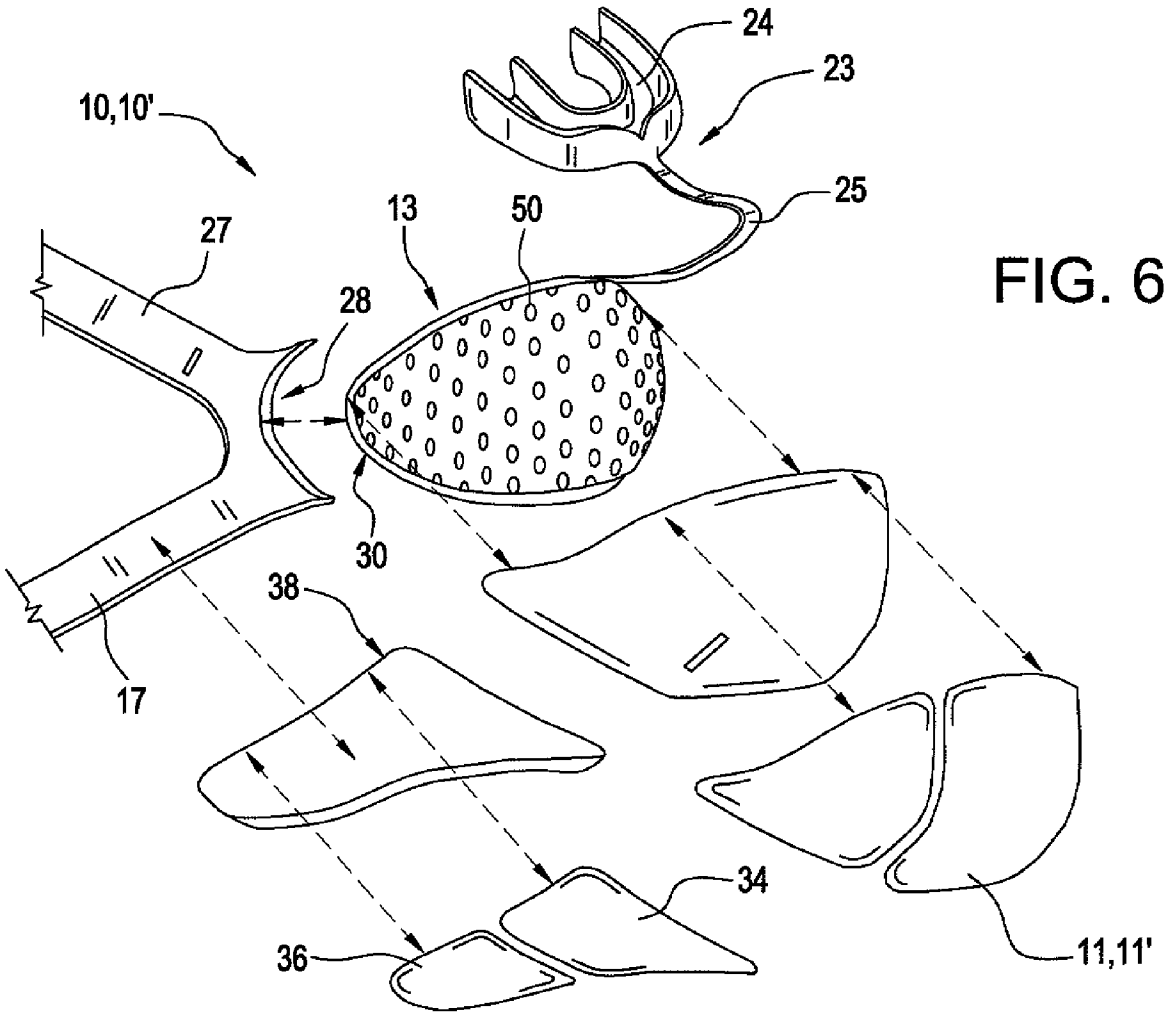
FIG. 6 shows an exploded perspective view of the embodiments of FIGS. 1 and 2 showing assembly of components.

FIG. 6 shows an exploded perspective view explaining the manner of assembly of the components of the inventions consisting of the embodiments of FIGS. 1 and 2. Notably, the straps 17 and 27 are seen to be interconnected adjacent the edge 28 and that edge 28 is affixed to the edge 30 of the webbing 13 by any suitable means such as stitching, adhesive or other attachment means. Comparing FIG. 6 first to FIG. 1, in FIG. 1, the strap 17 extends through a slot 44 between the plates 34 and 36 of the jaw protector 31. As should be understood from FIG. 6, after the strap 17 extends through the slot 44, it extends under the jaw protector to the location adjacent the edge 28. With reference to the embodiment of FIG. 2, the strap 17 is affixed at the end 39 of the jaw protector 31. As should be understood from FIG. 6, the strap 17 continues under the jaw protector 31 until it terminates at the location adjacent the edge 28. The reference numerals 11, 11' in FIG. 6 are intended to convey that FIG. 6 is equally applicable to both embodiments, FIGS. 1 and 2, regardless of the profile of the chin cup.

Figure 3:
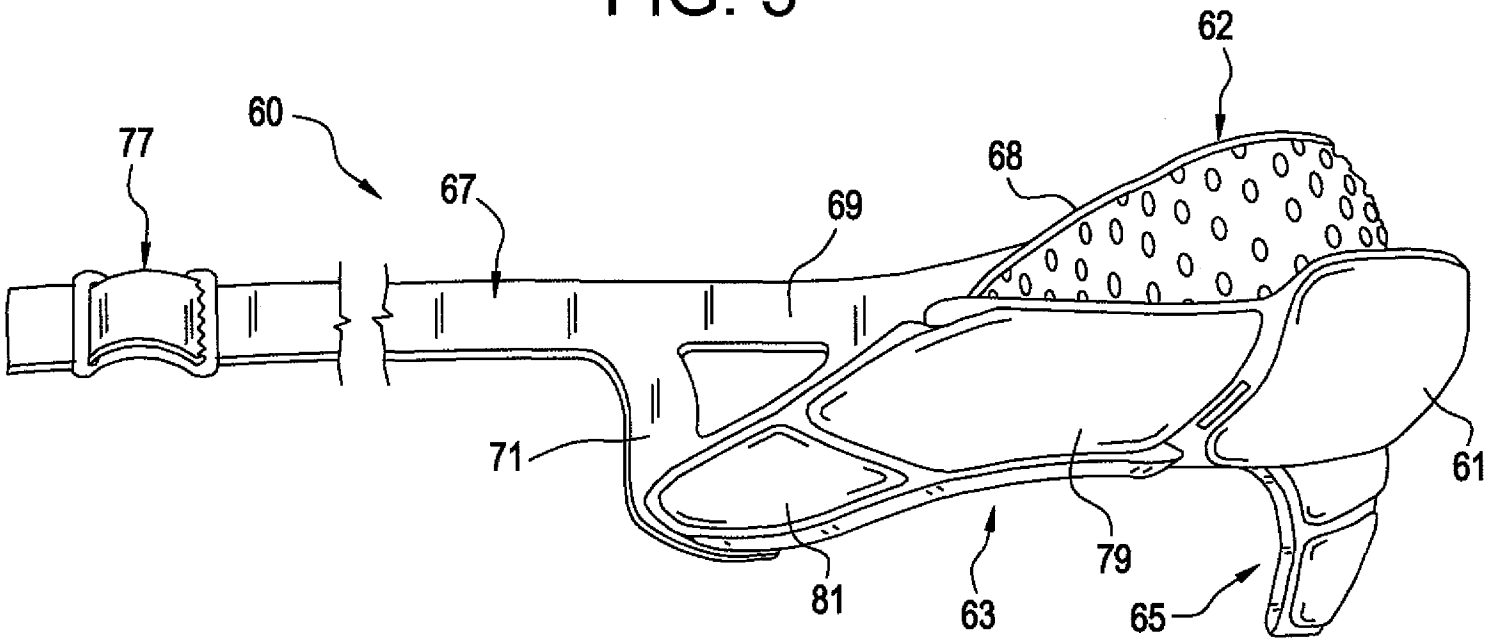
FIG. 3 shows a perspective view of a third embodiment showing two-point attachment and the webbing exposed by a low profile chin cup.
Figure 4:
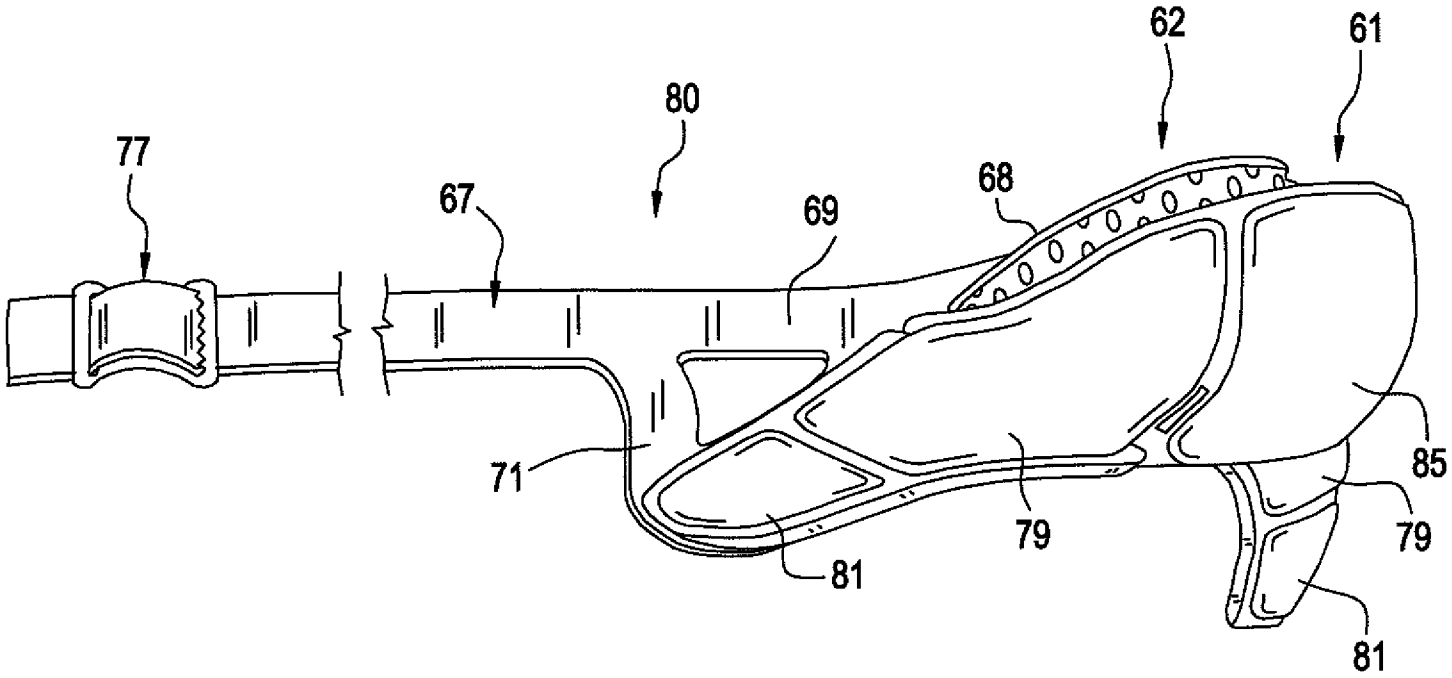
FIG. 4 shows a fourth embodiment showing an alternative with two-point attachment and a relatively large chin cup.

With reference now to FIGS. 3-4, further embodiments of the present invention are shown in which a two strap attachment system is employed. In particular, with reference first to FIG. 3, the invention is generally designated by the reference numeral 60 and includes a low profile chin cup 61 to which are affixed jaw protectors 63, 65. A strap 67 is affixed to the side 68 of the webbing 62 as well as the side of the pad 63 in a branched attachment system 69, 71. As in the embodiments of FIGS. 1-2, a strap (not shown) may affix a mouthpiece (not shown) to the webbing 62. The fastener 77 is similar or the same as that which is designated by the reference numerals 45, 46 in FIGS. 1-2.

With further reference to FIG. 3, the jaw protector 63 includes plates 79, 81 made of a carbon fiber material and analogous in function to the plates 34 and 36 illustrated in FIGS. 1-2. Plate 79 is designed to conform to the shape of the face in order to provide constant protection and eliminate movement of the wing. By contrast, in FIGS. 1 and 2, the wings 31, 33 are much more flexible because straps 17 and 19 attach to the helmet.

The embodiment of FIG. 4, generally designated by the reference numeral 80, differs from the embodiment of FIG. 3 in that the chin cup 85 is higher profile than the chin cup 61, more corresponding to the chin cup 11 of FIG. 1.

In the preferred embodiments of the present invention, the straps are made of NYLON or other non-stretchable synthetic material or of leather or spun polyester or NYLON webbing encased in polyvinylchloride (PVC). The snap fasteners such as illustrated in FIG. 1 may be replaced with other fastening devices such as hook and pile fastening means known by the trademark VELCRO. The padding, chin cup and straps may be coated with desirable materials. Thus, the high density foam that may be used for the chin cup and the jaw protecting pads may be wrapped with a wicking material that allows perspiration to travel through padding channels and whereby the perspiration is released through a plurality of holes. Additionally, a synthetic cloth incorporating a KEVLAR weave may be used to cover high density foam surfaces of the chin cup and jaw protecting pads.

The high density foam preferred for use in making the chin cup and the jaw protecting pads is preferably a heat-moldable micro-cell design which allows the pads to form around the facial structure of the wearer for the best possible custom fit. The high density foam padding may be wrapped in a wicking material or a synthetic cloth. A socket (not shown) may be provided on the chin cup or webbing to provide a place to install the strap of a mouthpiece. The webbing may be formed of netting or perforated cloth material. It also may be lined with a perforated non-slip, temperature controlled, wicking material.

In the preferred embodiments of the present invention, the jaw protecting wing pads are fastened to their associated straps by stitching or a suitable adhesive or other interface.

The carbon fiber plates illustrated in the Figures may, if desired, be replaced with hard plastic plates. In either case, the plates may be fastened to their pads by adhesive, screws or, in fact, by providing recesses in the pads within which the plates are inserted and attached by any suitable means such as, for example, use of an adhesive.

Figure 5:
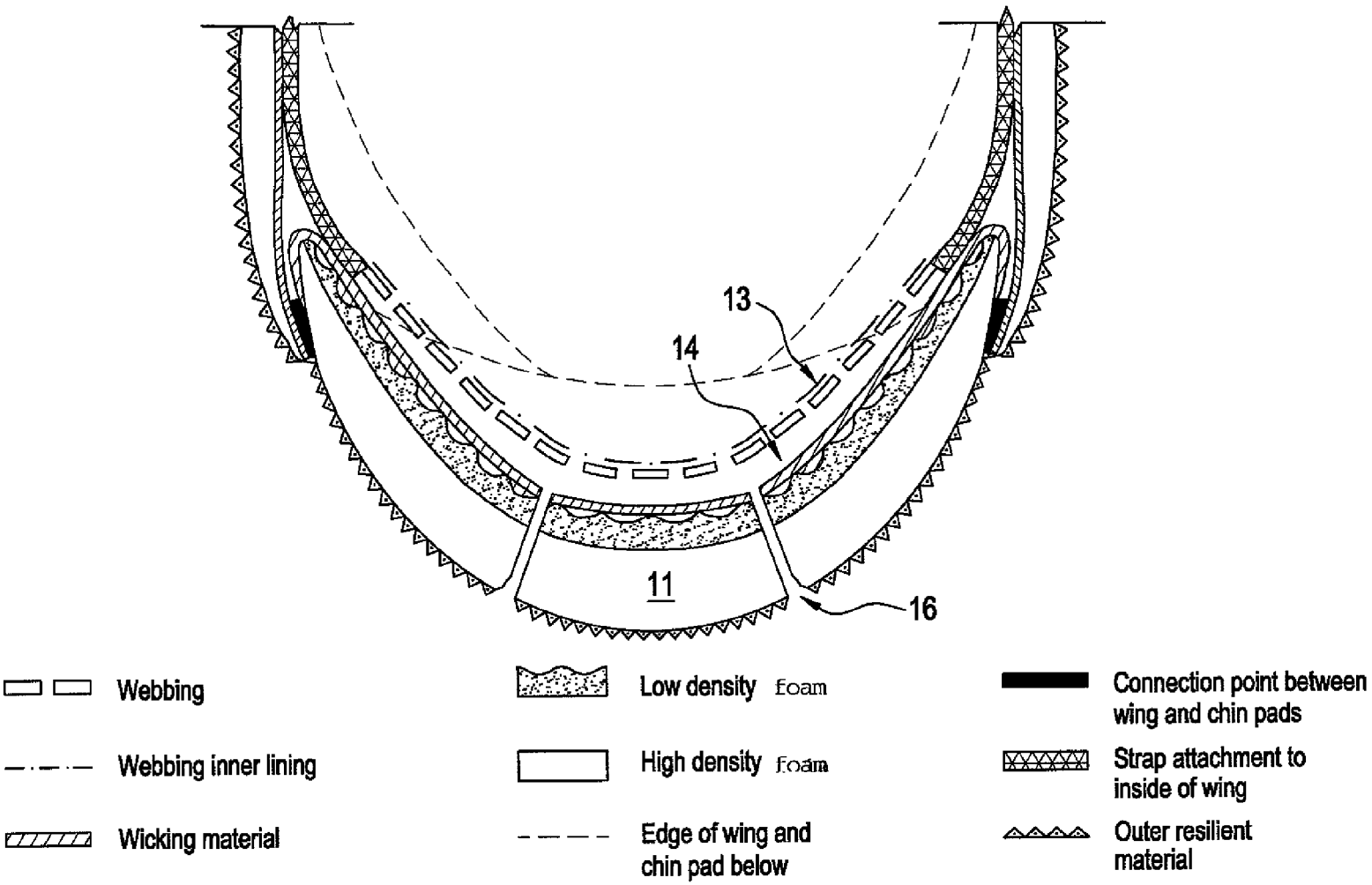
FIG. 5 shows details of the materials and the connection of the wing pads and webbing to the chin cup and lower strap.

In the preferred embodiments, the exterior surfaces of the webbing 13, 62 are slightly spaced from the internal surfaces of the chin cup 11 (see FIG. 5). This permits ventilation of the chin area to reduce perspiration and allow perspiration to leave the area through a wicking action. In that configuration, the chin cup still provides adequate cushioning and protection to the chin because space is provided for the webbing to stretch as the head and chin move within the helmet as a direct result of an impact, creating inertia displacement.

As such, through use of the present invention, a more adequate protection for the jaw area of the user is provided in a manner not contemplated by the prior art.

As such, an invention has been disclosed in terms of preferred embodiments thereof which fulfill each and every one of the objects of the present invention as set forth hereinabove, and provide a new and useful chinstrap with jaw protection of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A chinstrap, comprising:

a) a chin pad having first and second opposed sides and first and second chin pad side terminations and a recess sized to receive a wearer's chin;

b) a separate first jaw protecting pad having a first edge and a first length extending away from said first edge, said first edge abutting and affixed to said first side termination of said chin pad and a separate second jaw protecting pad having a second edge and a second length extending away from said second edge, said second edge abutting and affixed to said second side termination of said chin pad, each jaw protecting pad having a length extending away from a side termination to which it is affixed;

c) opposed straps comprising a strap to each side of said chin pad, wherein each of said straps is attached to one of said first and second jaw protecting pads, said straps having respective ends distal from said first and second jaw protecting pads and said distal ends bearing attachments facilitating releasable fastening to opposed sides of a helmet or other head protector;

d) each of said opposed straps having a first width, each of said first and second jaw protecting pads having a second width wider than said first width for at least a portion of said first or second lengths respectively and each of said jaw protecting pads being configured to overlie a portion of a wearer's jaw line remote from a wearer's chin and spaced from said first and second side terminations when said chin pad surrounds a wearer's chin and said straps are fastened to opposed sides of a helmet or other head protector.

2. The chinstrap of claim 1, wherein said chin pad carries a webbing slightly spaced from inner surfaces of said recess at an upper edge thereof, said webbing sized to receive a wearer's chin and assisting said chin pad in cushioning impacts.

3. The chinstrap of claim 2, wherein said webbing has a mouth guard connected thereto via a strap.

4. The chinstrap of claim 1, wherein each jaw protecting pad is generally triangular.

5. The chinstrap of claim 2, wherein each jaw protecting pad is made of a high density foam material.

6. The chinstrap of claim 5, wherein each jaw protecting pad has a rigid plate mounted on a front surface thereof.

7. The chinstrap of claim 6, wherein each rigid plate is made of a material chosen from the group consisting of carbon fiber material and hard plastic material.

8. The chinstrap of claim 1, wherein said chin pad is made of high density foam material.

9. The chinstrap of claim 8, wherein said chin pad includes a drain facilitating drainage of liquids therefrom.

10. The chinstrap of claim 1, wherein said opposed straps comprise two straps to each side of said chin pad.

11. The chinstrap of claim 2, wherein said opposed straps comprise two straps to each side of said chin pad.

12. The chinstrap of claim 11, wherein one of said two straps is connected to a jaw protecting pad and said two straps are also connected to said webbing.

13. A chinstrap, comprising:

a) a chin pad having first and second opposed sides and first and second chin pad side terminations and a recess sized to receive a wearer's chin, said chin pad carrying a webbing slightly spaced from inner surfaces of said recess at an upper edge thereof, said webbing sized to receive a wearer's chin and assisting said chin pad in cushioning impacts;

b) a separate first jaw protecting pad having a first edge and a first length extending away from said first edge, said first edge abutting and affixed to said first side termination of said chin pad and a separate second jaw protecting pad having a second edge and a second length extending away from said second edge, said second edge abutting and affixed to said second side termination of said chin pad, each jaw protecting pad having a length extending away from one of the first or second side terminations to which it is affixed;

c) opposed straps comprising a strap to each side of said chin pad, wherein each of said straps is attached to said first and second jaw protecting pads, said straps having respective ends distal from said first and second jaw protecting pads and said distal ends bearing attachments facilitating releasable fastening to opposed sides of a helmet or other head protector;

d) each of said opposed straps having a first width, each of said first and second jaw protecting pads having a second width wider than said first width for at least a portion of said first or second lengths respectively and each of said jaw protecting pads being configured to overlie a portion of a wearer's jaw line remote from a wearer's chin and spaced from said first and second side terminations when said chin pad surrounds a wearer's chin and said straps are fastened to opposed sides of a helmet or other head protector, each jaw protecting pad being generally triangular, each jaw protecting pad being made of a high density foam material.

14. The chinstrap of claim 13, wherein said webbing has a mouth guard connected thereto via a strap.

15. The chinstrap of claim 13, wherein each jaw protecting pad has a rigid plate mounted on a front surface thereof made of a material chosen from the group consisting of carbon fiber material and hard plastic material.

16. The chinstrap of claim 13, wherein said opposed straps comprise two straps to each side of said chin pad, one of said two straps being connected to a jaw protecting pad and said webbing and another of said two straps being connected to said webbing.

* * * * *